United States Patent [19]

Schenck et al.

[11] 4,157,995

[45] Jun. 12, 1979

[54] PAPER COATING COMPOSITION CONTAINING A PIGMENT, A POLYMER IN THE FORM OF AN AQUEOUS DISPERSION AND ANOTHER POLYMER WHICH IS SOLUBLE IN WATER

[75] Inventors: Hans-Uwe Schenck, Wachenheim; Guenter Hirsch, Mutterstadt, both of Fed. Rep. of Germany

[73] Assignee: BASF Aktiengesellschaft, Fed. Rep. of Germany

[21] Appl. No.: 869,671

[22] Filed: Jan. 16, 1978

[30] Foreign Application Priority Data

Jan. 28, 1977 [DE] Fed. Rep. of Germany ..... 2703418
Dec. 2, 1977 [DE] Fed. Rep. of Germany ..... 2753693

[51] Int. Cl.[2] ..... C08L 33/02

[52] U.S. Cl. ..... 260/29.6 RW; 260/29.6 WB; 260/29.6 WQ; 260/29.7 W

[58] Field of Search ..... 260/29.6 WB, 29.6 WQ, 260/29.6 RW, 29.7 W

[56] References Cited

U.S. PATENT DOCUMENTS

| | | | |
|---|---|---|---|
| 3,081,198 | 3/1963 | Miller | 428/452 |
| 3,996,180 | 12/1976 | Kane | 260/29.6 WQ |

*Primary Examiner*—Maurice J. Welsh
*Attorney, Agent, or Firm*—Keil & Witherspoon

[57] ABSTRACT

An improved paper coating composition containing, per 100 parts by weight of finely divided pigment, from 5 to 25 parts by weight of a copolymer A having a glass transition temperature of from −40° to +50° C. in the form of an aqueous dispersion and from 0.1 to 10 parts by weight of a high molecular weight polymer B which is obtained by polymerizing water-soluble ethylenically unsaturated monomers in a water-in-oil emulsion. Papers having improved water resistance are obtained.

5 Claims, No Drawings

PAPER COATING COMPOSITION CONTAINING A PIGMENT, A POLYMER IN THE FORM OF AN AQUEOUS DISPERSION AND ANOTHER POLYMER WHICH IS SOLUBLE IN WATER

The present invention relates to a paper coating composition containing, per 100 parts by weight of a finely divided pigment, from 5 to 25 parts by weight of a polymer A having a glass transition temperature of from −40 to +50° C. in the form of an aqueous dispersion and from 0.1 to 10 parts by weight of one or more high molecular weight polymers B which are soluble in water.

Conventionally, coated printing papers are manufactured using paper coating compositions which essentially consist of a water-dispersed pigment, e.g. kaolin, calcium carbonate or titanium dioxide, and a binder. Whilst previously high molecular weight natural products, e.g. starches or casein, were used exclusively as the binder, attempts are being made increasingly to replace the natural products entirely or partially by synthetic, high molecular weight polymers in the form of aqueous dispersions. Binders based on natural products have the disadvantage that they are not always obtained in the same quality, that they are sensitive to attack by micro-organisms, that the natural products used in their preparation must be digested by expensive processes, and that they give brittle coatings. It is true that binders based on synthetic high molecular weight polymers do not exhibit all the said disadvantages of the natural binders, but they nevertheless require improvement.

U.S. Pat. No. 3,081,198 discloses that mixtures of a polymer dispersion which is insoluble in alkalis, and of an alkali-soluble copolymer which contains from 15 to 40% by weight of an ethylenically unsaturated caboxylic acid as copolymerized units, may be used as binders for paper coating compositions. Instead of the polymer dispersion, binders based on natural products can also be used. However, the use of these binders in paper coating compositions results in coated papers of insufficient wet strength. The conventional paper coating compositions can furthermore not be processed satisfactorily on high-speed coating units.

It is an object of the present invention to provide a paper coating composition which exhibits high water retention and gives coated papers of high wet strength.

We have found that this object is achieved, according to the invention, by using the initially described paper coating composition if component B is manufactured by polymerizing one or more water-soluble ethylenically unsaturated compounds in a water-in-oil emulsion.

The said binder combinations impart high water retention to the paper coating compositions according to the invention, so that these compositions can readily be processed on conventional coating units. Though the copolymer B is soluble in water, the coated papers obtained surprisingly have a substantially greater wet strength than papers which have been coated with the conventional paper coating compositions.

Suitable copolymers A are all commercial synthetic binders which are in the form of an aqueous dispersion. The polymers have a glass transition temperature of from −40 to +50° C. Examples of typical monomers peresent in these polymers are acrylates and methacrylates, acrylonitrile, methacrylonitrile, acrylamide, methacrylamide, ethylenically unsaturated mono-carboxylic and dicarboxylic acids of 3 to 5 carbon atoms, halfesters of ethylenically unsaturated dicarboxylic acids of 3 to 5 carbon atoms, vinyl chloride, vinylidene chloride, mono- or polyethylenically unsaturated hydrocarbons, e.g. ethylene, propylene, butylene, 4-methyl-1-pentene, styrene, butadiene, isoprene and chloroprene, vinyl esters, vinylsulfonic acid and esters of ethylenically unsaturated carboxylic acids derived from polyhydric alcohols, e.g. hydroxypropyl acrylate and hydroxypropyl methacrylate.

Suitable copolymers A are disclosed in, for example, German Published Application DAS 1,100,450. In addition to an acrylate, such copolymers may contain styrene and/or butadiene and/or acrylonitrile, as well as ethylenically unsaturated acids. Instead of the acids, other polymerizable hydrophilic compounds may be present as copolymerized units in the copolymers, examples being hydroxyl-containing monomers, e.g. hydroxypropyl acrylate and hydroxypropyl methacrylate. The acrylic esters employed in the polymerization may be derived, for example, from monohydric alcohols of 1 to 12 carbon atoms. The acrylate content in these copolymers can vary within wide limits and may, for example, be from 10 to 99%, or acrylate homopolymers may be used. The content of ethylenically unsaturated acids in these copolymers is as a rule up to 10% by weight. Suitable ethylenically unsaturated acids are especially acrylic acid, methacrylic acid, vinylsulfonic acid, acrylamidopropanesulfonic acid and itaconic acid.

The polymethacrylates have a similar structure to that of the polyacrylates, but contain a methacrylate instead of an acrylate. However, it is also possible to copolymerize acrylates and methacrylates with other ethylenically unsaturated compounds and use the product as component A of the binder combination. For example, ethylene or propylene may also be used as the comonomer.

Further suitable copolymers A are copolymers of butadiene and styrene. These copolymers contain from 20 to 60% by weight of butadiene and from 40 to 80% by weight of styrene and/or acrylonitrile. They may contain further comonomers, for example esters of ethylenically unsaturated carboxylic acids of 3 to 5 carbon atoms, with or without up to 10% by weight of other ethylenically unsaturated copolymerizable compounds, e.g. acrylic acid, methacrylic acid, maleic acid, crotonic acid and fumaric acid. Polymers of this type, and also polyacrylates, are disclosed, for example, in German Pat. No. 1,546,316. Suitable styrene-butadiene copolymers which contain an ethylenically unsaturated carboxylic acid or a halfester of an ethylenically unsaturated dicarboxylic acid as copolymerized units and are used as the copolymer A are disclosed in German Published Application DAS No. 1,221,748.

Further polymers which may be used as copolymer A in the paper coating composition according to the invention are those derived from vinyl esters, e.g. of the type of vinyl acetate or vinyl propionate, or from polymerizable hydrocarbons, e.g. ethylene or propylene, for example copolymers of vinyl esters with acrylates and/or methacrylates and/or acrylonitrile and other compounds which, however, are hydrophilic, e.g. ethylenically unsaturated acids or hydroxyl-containing monomers. The copolymers may also contain yet further ethylenically unsaturated compounds, e.g. acrylamide, N-methylolacrylamide, N-methylolmethacrylamide, vinyl chloride or vinylidene chloride, as copolymerized units. Suitable vinyl ester copolymers are disclosed, for example, in German Pat. No. 1,264,945. Homopolymers of vinyl esters may also be used.

The polymers B are soluble in water and have a high molecular weight. They are obtained by polymerizing water-soluble, ethylenically unsaturated compounds in a water-in-oil emulsion. A process for the manufacture of such polymers is disclosed, for example, in German Pat. No. 1,089,173. The ethylenically unsaturated monomers are dissolved in water and the polymerization is carried out in a water-in-oil dispersion. The continuous, outer oily phase of the water-in-oil dispersion may be, for example, a hydrophobic hydrocarbon, e.g. gasoline cuts, or chlorohydrocarbons, e.g. perchloroethylene or 1,2-dichloroethane. The proportion of aqueous disperse phase is from about 30 to 70% of the emulsion but may also be greater, in particular up to 90% by weight. Examples of suitable water-soluble monomers are ethylenically unsaturated carboxylic acids of 3 to 5 carbon atoms, e.g. acrylic acid, methacrylic acid and itaconic acid, the corresponding amides, e.g. acrylamide and methacrylamide, and the salts of the said ethylenically unsaturated carboxylic acids. The said monomers may be either homopolymerized or copolymerized with one another, so that copolymers, e.g. of acrylamide and acrylic acid, are obtained. Comonomers which may be used when polymerizing the water-soluble ethylenically unsaturated monomers are, for example, vinylbenzenesulfonates, acrylamidopropanesulfonic acid and vinylsulfonic acid, and minor amounts, of up to about 20% by weight, of ethylenic compounds of limited solubility in water, e.g. acrylates and methacrylates, acrylonitrile and methacrylonitrile.

It is also advantageous to increase the molecular weight of the water-soluble polymers by slight crosslinking through the incorporation of compounds which contain several ethylenically unsaturated double bonds. In order slightly to crosslink the water-soluble polymers, from 0.01 to 5% by weight, based on the monomer mixture, of a monomer with at least 2 ethylenically unsaturated double bonds, e.g. ethylenedivinylurea, divinyldioxane, methylene-bis-acrylamide, ethylene-bis-acrylamide, propylene-bis-acrylamide, allyl acrylate, methallyl methacrylate, diallyl malonate, divinyl ether, glycol diacrylate or a polyallyl-polyether of a polyhydric alcohol, e.g. trimethylolpropane-triallyl ether or polyallyl-sucrose, is added when polymerizing the monomers.

Under the conditions, copolymers with particularly high molecular weights are obtained. The molecular weights of the water-soluble polymers B of the binder mixture are from 100,000 to 20 million, preferably from 1 million to 20 million.

The polymerization of the aqueous monomer solution in the hydrocarbon oil may be carried out in accordance with conventional processes in a temperature range of from 5° to 120° C. In order to disperse the aqueous monomer solution in the hydrocarbon oil, conventional water-in-oil emulsifiers may be used, e.g. sorbitan monostearate, sorbitan monooleate, glycerol esters of which the acid component is derived from carboxylic acids of 14 to 20 carbon atoms, cetyl or stearyl sodium phthalate or emulsifiers such as those described in German Laid-Open Application DOS No. 2,536,537.

These emulsifiers have an HLB value of at most 8. By the HLB value there is understood the hydrophilic-lipophilic balance of the emulsifier, i.e. the balance in size and strength of the hydrophilic and lipophilic groups of the emulsifier. A definition of this term is to be found, for example, in "Das Atlas HLB-System", Atlas Chemie GmbH, EC 10 G July 1971, and in the Classification of Surface Active Agents by "HLB", W. C. Griffin, Journal of the Society of Cosmetic Chemists, page 311 (1950).

The finished dispersion generally contains from 0.1 to 30, preferably from 1 to 10, % by weight of these emulsifiers.

Further, a surfactant having an HLB value above 10 can be added to the water-in-oil emulsion to be polymerized. Such surfactants are essentially hydrophilic water-soluble products, e.g. oxyethylated alkylphenols, sodium salts of dialkyl sulfosuccinates, where alkyl is of not less than 3 carbon atoms, soaps derived from fatty acids of 10 to 22 carbon atoms and alkali metal salts of alkyl-sulfates or alkenyl-sulfates of 10 to 26 carbon atoms. Preferred surfactants are oxyethylated nonylphenols with a degree of oxyethylation of from 6 to 20, oxyethylated nonylphenol/formaldehyde resins with a degree of oxyethylation of from 6 to 20, sodium dioctyl sulfosuccinate and octylphenol-polyethoxyethanol.

To prepare the water-in-oil dispersions, the surfactant having an HLB value greater than 10 may be added to the aqueous phase, to the liquid hydrocarbon or to the finished monomer emulsion. In the preferred embodiment of the process, the surfactant and the water-in-oil emulsifier are dissolved or suspended in the liquid hydrocarbon which serves as the continuous phase of the dispersion.

This mixture, together with the aqueous monomer solution, is then converted to a water-in-oil emulsion, for example whilst stirring. The sequence of addition of the components to the polymerization batch is not critical. The only essential feature is that if a surfactant having an HLB value greater than 10 is used, it should be added before the polymerization.

The monomers may be polymerized in the presence of the conventional polymerization initiators; for example, peroxides, e.g. benzoyl peroxide and lauroyl peroxide, hydroperoxides, hydrogen peroxide, azo compounds, e.g. azoisobutyronitrile, and redox catalysts are used. The polymerization temperature depends on the polymerization initiator used and can vary within a wide range, for example from 5° to 120° C. As a rule, polymerization is carried out under normal pressure at from 40° to 80° C., whilst ensuring that the components are mixed thoroughly. The monomers are polymerized virtually completely.

The finished water-in-oil dispersion generally comprises from 30 to 90% of an aqueous phase. The aqueous phase contains virtually the entire polymer. The concentration of the polymer in the aqueous phase is generally from 20 to 60% by weight. The amount of the optionally employed surfactant having an HLB value greater than 10 is generally from 0.1 to 10% by weight, based on the total dispersion. The continuous outer phase of the water-in-oil polymer dispersion generally accounts for from 10 to 70% by weight of the total dispersion.

Preferably, the polymer B is a homopolymer of an alkali metal salt or ammonium salt of acrylic acid or acrylamide or a copolymer of from 5 to 95% by weight of acrylamide and from 95 to 5% by weight of an alkali metal salt or ammonium salt of acrylic acid.

What is essential in every case is that the polymer B should be manufactured by the water-in-oil emulsion polymerization process and should also be in this form when incorporated, together with the copolymers A, into the paper coating composition. In the form of the water-in-oil dispersion, the polymers B have a relatively low viscosity which is generally from 100 to 5,000 mPa.s. They are therefore easy to handle. When processed together with the water-insoluble synthetic binder (copolymer A), it is the polymer B which determines the viscosity of the paper coating composition. The polymer B, incorporated in the form of its water-in-oil dispersion, acts as a thickener, increases the water retention capacity of the coating composition and improves the properties, especially the wet strength, of the finished paper. The effects described can be achieved even using relatively small amounts of polymer B; for example, preferably from 0.2 to 3 parts by weight of water-soluble polymer in the form of its water-in-oil dispersion (the amount being based on 100 parts by weight of pigment) suffice to achieve the above improvement in quality of the coating composition and of the paper.

The paper coating compositions according to the invention contain, per 100 parts by weight of pigment, from 5 to 25 parts by weight of copolymer A, and from 0.1 to 10 parts by weight of the solid polymer B in the form of its water-in-oil dispersion. These polymer combinations are excellent binders for paper coating compositions. To produce the paper coating composition according to the invention, the polymers A and B may be mixed with one or more fillers and/or pigments by conventional methods. Suitable fillers are especially clay minerals, calcium carbonate, calcium aluminum pigments and titanium dioxide. Other assistants may or may not be added to the paper coating compositions, examples being alkalis, e.g. sodium hydroxide, potassium hydroxide or ammonia, and white pigments based on water-insoluble urea/formaldehyde condensation products, as well as other conventional paper assistants, e.g. urea, melamine or formaldehyde resins.

The sequence in which the individual components of the paper coating composition are mixed is not critical, but it has proved advantageous to add the copolymer B at the end of the preparation of the coating composition.

The Examples which follow illustrate the invention. In the Examples, parts and percentages are by weight. The K values of the polymers were determined by the method of H. Fikentscher, Cellulosechemie 13 (1932), 58–64 and 71–74, in 5% strength aqueous sodium chloride solution at 25° C.; $K = k.10^3$.

Preparation of the water-soluble polymer B

Polymer B 1

The following components are mixed in a vessel provided with a stirrer, thermometer and nitrogen inlet and outlet: 347 parts of a mixture of 84% of saturated aliphatic hydrocarbons and 16% of naphthenic hydrocarbons (boiling point of the mixture 192°–254° C.), 53.3 parts of sorbitan monooleate and 20 parts of oxyethylated nonylphenol (degree of oxyethylation from 8 to 12). A solution of 133.6 parts of acrylamide and 59 parts of acrylic acid in 389.4 parts of water, the pH of the solution having been brought to 8.0 with 18 parts of sodium hydroxide, is then added and the aqueous solution is emulsified in the hydrocarbon oil. Nitrogen is then passed over the mixture for 30 minutes, after which the mixture is heated to 60° C. in the course of 15 minutes. At this temperature, a solution of 0.212 part of 2,2'-azo-bis-isobutyronitrile dissolved in a small amount of acetone is added. When the mixture has been heated at 60° C. for 3 hours, the polymerization is complete. A coagulate-free, sedimentation-stable water-in-oil dispersion of a copolymer of 35% of acrylamide and 65% of sodium acrylate is obtained, which is used as a thickener, having co-binder properties, in paper coating compositions. The K value of the polymer is 247.5.

Polymer B 2

The procedure described in Example 1 is followed and 10 parts of an oxyethylated nonylphenol, the degree of oxyethylation being from 8 to 12, and 40 parts of the emulsifier described in Example 1 of German Laid-Open Application DOS No. 2,536,597 are dissolved in 220 parts of a mixture of 84% of saturated aliphatic hydrocarbons and 16% of naphthenic hydrocarbons (boiling range of the mixture 192°–254° C.). A solution of 285 parts of acrylic acid in 128 parts of water, which has been brought to pH 7.0 with 285 parts of 22.5% strength aqueous ammonia and to which 0.4 part of $Na_4P_2O_7$ and 0.01 part of propylene-bis-acrylamide have been admixed, is added to the preceding mixture.

The organic phase and the aqueous solution are mixed with efficient stirring, so that a water-in-oil emulsion is obtained. Nitrogen is then passed over the emulsion for 30 minutes, after which the emulsion is heated to 70° C. in the course of 15 minutes. At this temperature, a solution of 0.212 part of 2,2'-azo-bis-iso-butyronitrile dissolved in a little acetone is added and the temperature of the mixture is kept at 70° C. for 3 hours. A coagulate-free, sedimentation-stable water-in-oil dispersion is obtained.

The viscosity of an 0.3% strength (expressed as polymer) aqueous solution prepared therefrom with demineralized water is 1,150 mPa.s (Brookfield viscometer, 20 rpm, 20° C., RV 2).

EXAMPLE 1

A paper coating composition which is suitable for the manufacture of paper for offset printing is obtained by finely dispersing 80 parts of coating clay and 20 parts of calcium carbonate pigment, using a powerful dispersing unit, to give an about 66% strength aqueous slurry, using 0.2 part of sodium hydroxide and 0.3 part of a commercial dispersant. 12 parts, expressed as solids, of a copolymer A of 50% of n-butyl acrylate and 50% of styrene (glass transition temperature from 20° to 30° C.) in the form of an aqueous dispersion are added to the pigment slurry. 0.5 part, expressed as solids, of polymer B 1 in the form of the water-in-oil dispersion is then added with vigorous stirring and the solids content of the coating composition is brought to about 58% by adding water. The pH of the coating composition is brought to 8.5 with sodium hydroxide solution. After mixing for 15 minutes, the paper coating composition can be processed, for example on a knife coater. The properties of the coating composition and of the coating composition and of the paper coated therewith are shown in the Table.

EXAMPLE 2

A coating composition for the manufacture of coated board is obtained, by the method described in Example 1, by mixing the pigment slurry, described in Example 1, with 15 parts, expressed as solids, of a copolymer A which is a commercial butadiene-styrene copolymer (48% of butadiene and 48% of styrene, glass transition temperature from 0° to +15° C.) which contains 4% of carboxyl groups and is in the form of an aqueous dispersion; water is then added until the solids content of the mixture is 43%. 0.7 part, expressed as solids, of polymer B 2 in the form of the water-in-oil dispersion is then added. The pH is then brought to 8.5 and the mixture is homogenized for 15 minutes. A coating composition which can be processed satisfactorily on an air-knife coater or a roller knife coater, is obtained. The properties of the coating composition and of the board coated therewith are shown in the Table.

EXAMPLE 3

To produce a paper coating suitable for gravure printing, a 66% strength pigment slurry of 100 parts of coating clay, 0.2 part of sodium hydroxide and 0.3 part of a commercial dispersant is mixed with 6 parts, expressed as solids, of a commercial synthetic binder, obtained from 50% of n-butyl acrylate and 50% of vinyl acetate (glass transition temperature-20° to +25° C.) as copolymer A. The viscosity of the coating composition is adjusted by adding 0.35 part, expressed as solids, of polymer B 2 as a water-in-oil emulsion. The solids content of the coating composition is then brought to 59%, and the pH to 9, by adding water and sodium hydroxide solution. After a mixing time of 15 minutes, the paper coating composition can be processed entirely satisfactorily on a knife coater. The results are summarized in the Table.

EXAMPLE 4

To produce a wallpaper coating, 90 parts of coating clay and 10 parts of a titanium dioxide pigment are converted to a 66% strength aqueous slurry by means of 0.2 part of sodium hydroxide and 0.4 part of a commercial dispersant. 13 parts, expressed as solids, of a copolymer A of about 50% of n-butyl acrylate and about 50% of styrene (glass transition temperature 20°-30° C.) in the form of an aqueous dispersion are then added. The coating composition is thickened by adding 0.8 part, expressed as solids, of polymer B 2 in the form of its water-in-oil dispersion and homogenizing the mixture. The solids content of the paper coating composition is brought to 54% and the pH to 9, by adding water and sodium hydroxide. After a mixing time of 15 minutes, the coating composition can be processed satisfactorily on roller coaters or knife coaters. The viscosity of the paper coating composition was 1,690 mPa.s and the water retention of the composition was 93 sec.

In Comparative Examples 1 to 3, the coating compositions corresponding to Examples 1 to 3 were produced but, as a modification of the original Examples, the polymers B 1 and B 2 employed were copolymers which, though corresponding in composition to those employed in the Examples, were produced by polymerizing the monomers in aqueous solution. As may be seen from the Table, the paper coating compositions produced with the aid of the binder combination according to the invention show a surprisingly improved water retention.

In the Table, the water retention is specified in seconds. It is the time in which the aqueous phase of the coating composition, colored with an acid red dye, has penetrated through a blue-ribbon filter to the point that the reflectance of the latter, measured by means of a reflectance photometer (filter 4), has fallen to 40% of the original reflectance. In Comparative Example 4, a paper coating composition was prepared as described above, but instead of the water-in-oil dispersion of the polymer B 2, a copolymer, produced by solution polymerization, of about 80% of butyl acrylate and about 20% of acrylic acid was employed. A paper coating composition having a viscosity of 1,540 mPa.s and a water retention of 65 sec. was obtained.

Table 1 summarizes both the properties of the coating compositions and some properties of the coatings. It is apparatent that the use of the paper coating compositions according to the invention results in substantially improved wet pick resistance values.

The wet pick resistance was determined as follows:

Preparation of the Papers and Boards

The papers and boards to be tested are suspended individually and conditioned for 24 hours. The picking strips, of size 35 × 3 cm, are cut out in the lengthwise direction of the paper web, and are sampled over the entire width of the web. The strips must not lie on one another whilst being conditioned.

Test Instrument

The wet picking test is carried out with the IGT model AC 2 printability tester.

Picking Ink

Printing inks from Lorilleux were used as the picking inks. The picking ink used must match the picking tendency of the paper or board. Normally, good results are obtained with Lorilleux green ink 3804.

Picking Test Method

The paper or board strip is clamped onto the circular segment of the IGT tester as for the dry pick resistance test.

A pressure disc about 3.2 cm wide is mounted on the upper pressure disc axle and an inked 2 cm wide pressure disc on the lower pressure disc axle. The circular segment bearing the clamped test strip is then turned into the picking position. The pressure setting for both pressure discs is 70 kp. 0.2 $cm^3$ of water is then dripped between the circular segment, carrying the clamped test strip and the upper pressure disc, and picking is immediately carried out at constant speed, set to from 18 to 40 cm/s, since the time for the water to act is otherwise too short.

If no picking occurs with this setting, an ink which causes more severe picking must be employed.

The distance between the two pressure disc axles is 7 cm; at a picking speed of 18 or 40 cm/s this corresponds to an exposure time of 0.39 and 0.17 s respectively.

If, on a printing machine, the distance between two successive print units is 1 m and the machine runs at 100 m/min, then this corresponds to an exposure time of 0.6 s.

Evaluation

In the process used, the last half of the strip is first moistened and then printed. If the wet pick resistance, for the particular picking ink and at the particular speed, is insufficient, picking is observed on the strip which has been moistened. The various strips are evaluated subjectively by comparing them with one another.

Evaluation by means of a Densitometer is also possible.

In this case, the depth of color over the tested picking strip is measured and a corresponding value D of the color density, which depends on the pick resistance of the paper or board, is obtained. For comparison, a strip printed full shade with the test ink is measured.

TABLE 1

| Properties | Example 1 | Comparative Example 1 | Example 2 | Comparative Example 2 | Example 3 | Comparative Example 3 | Example 4 | Comparative Example 4 |
|---|---|---|---|---|---|---|---|---|
| a) Coating composition | | | | | | | | |
| Viscosity [mPa.s] | 1,312 | 1,045 | 460 | 380 | 1,140 | 1,070 | 1,690 | 1,540 |
| Water retention [sec] | 106 | 36 | 48 | 33 | 61 | 23 | 93 | 65 |
| b) Coated paper | | | | | | | | |
| Wet picking test [D] | 0.89 | 0.38 | 0.47 | 0.36 | — | — | 0.66 | 0.38 |
| Ink pick-up [%] | 24.4 | 24.0 | 20.3 | 17.3 | 45.7 | 42.3 | 25.6 | 21.7 |

We claim:

1. An improved paper coating composition containing, per 100 parts by weight of finely divided pigment, from 5 to 25 parts by weight, expressed as solids, of a polymer A having a glass transition temperature of from −40° to +50° C. in the form of an aqueous dispersion and from 0.1 to 10 parts by weight of a high molecular weight polymer B which is soluble in water, wherein the improvement consists in producing the polymer B by polymerizing at least one water-soluble ethylenically unsaturated monomer in a water-in-oil emulsion.

2. An improved paper coating composition as set forth in claim 1, wherein the polymer B has been obtained by polymerizing ethylenically unsaturated carboxylic acids of 3 to 5 carbon atoms and/or their amides.

3. An improved paper coating composition as set forth in claim 1, wherein the polymer B is selected from the group consisting of homopolymers of acrylamide and methacrylamide and copolymers thereof with acrylic acid and methacrylic acid and mixtures thereof.

4. An improved paper coating composition as set forth in claim 1, wherein the component A is selected from the group consisting of acrylic ester polymers, methacrylic ester polymers, copolymers of butadiene with styrene and/or acrylonitrile, and vinyl ester polymer.

5. An improved paper coating composition as set forth in claim 1, wherein the polymer B has a molecular weight of from 1 million to 20 million.

* * * * *